United States Patent [19]

Howard

[11] Patent Number: 4,520,584

[45] Date of Patent: Jun. 4, 1985

[54] DISPLAY SCREENS AND THE LIKE

[75] Inventor: Robert Howard, Thornlie, Australia

[73] Assignee: Daventry Pty. Ltd., Subiaco, Australia

[21] Appl. No.: 495,612

[22] Filed: May 18, 1983

[30] Foreign Application Priority Data

Mar. 11, 1983 [AU] Australia ..... PF8409

[51] Int. Cl.[3] ..... G09F 15/00

[52] U.S. Cl. ..... 40/606; 40/152.1

[58] Field of Search ..... 40/606, 152.1, 602, 40/6 R, 605, 611; 248/441 R, 460

[56] References Cited

U.S. PATENT DOCUMENTS 2,236,888 4/1941 Bishop ..... 40/606

2,345,913 4/1944 Bishop ..... 40/606

2,454,648 11/1948 Green ..... 40/606

2,880,534 4/1959 Lund ..... 40/152.1

*Primary Examiner*—Gene Mancene

*Assistant Examiner*—James R. Hakomaki

*Attorney, Agent, or Firm*—Harness, Dickey & Pierce

[57] ABSTRACT

A display screen comprising a planar display panel, a pair of end panels and a pair of brace members, each end panel being mounted to the sides of the display panel to extend transversly from each face thereof and engage opposed portions of each face for a portion of the height of the display panel, each brace member being located one to each side of the display panel and having a horizontal portion extending between the end panel in abutting relationship with the face of the display panel.

8 Claims, 7 Drawing Figures

DISPLAY SCREENS AND THE LIKE

This invention relates to display screens, blackboards and divider partitions.

Throughout the specification the term display screen shall be taken to include portable display screens, blackboards and partitioning screens.

In one form the invention resides in a display screen comprising a planar display panel, a pair of end panels and a pair of brace members, each end panel being mounted to the sides of the display panel to extend transversly from each face thereof and engage opposed portions of each face for a portion of the height of the display panel, each brace member being located one to each side of the display panel and having a horizontal portion extending between the end panel in abutting relationship with the face of the display panel.

According to a preferred feature of the invention said end panel comprises two portions each mounted to one or the other face of the display panel to be pivotal thereon for movement between a position extending transversly from the face of said display panel and a position substantially co-planar with said display panel.

According to a preferred feature of the invention said brace members comprise an elongate member mounted to each face of the display panel to be pivotal between a position extending transversly from the face of said display panel and a position substantially co-planar therewith, the ends of said brace being lockingly inter-engagable with the portions of said end panel when both are substantially transverse to the face of said display panel.

According to a preferred feature of the invention said end panels, brace members and display panel are formed as separate items readily engagable and disengagable from each other.

According to a further preferred feature of the invention said brace member also comprises a substantially vertical planar member which is to extend between the end panels.

According to a preferred feature of the invention said end panels are formed with a substantially vertical slot into which the display panel is engaged.

According to a further preferred feature of the invention the display panel, brace members and end panels are formed of fibreboard and are held in engagement with each other when in the mounted position by tabs on one member being received in suitably shaped apertures formed in the other members.

The invention will be more fully understood in the light of the following description of one specific embodiment. The description is made with reference to the accompanying drawings of which;

Figure 1:
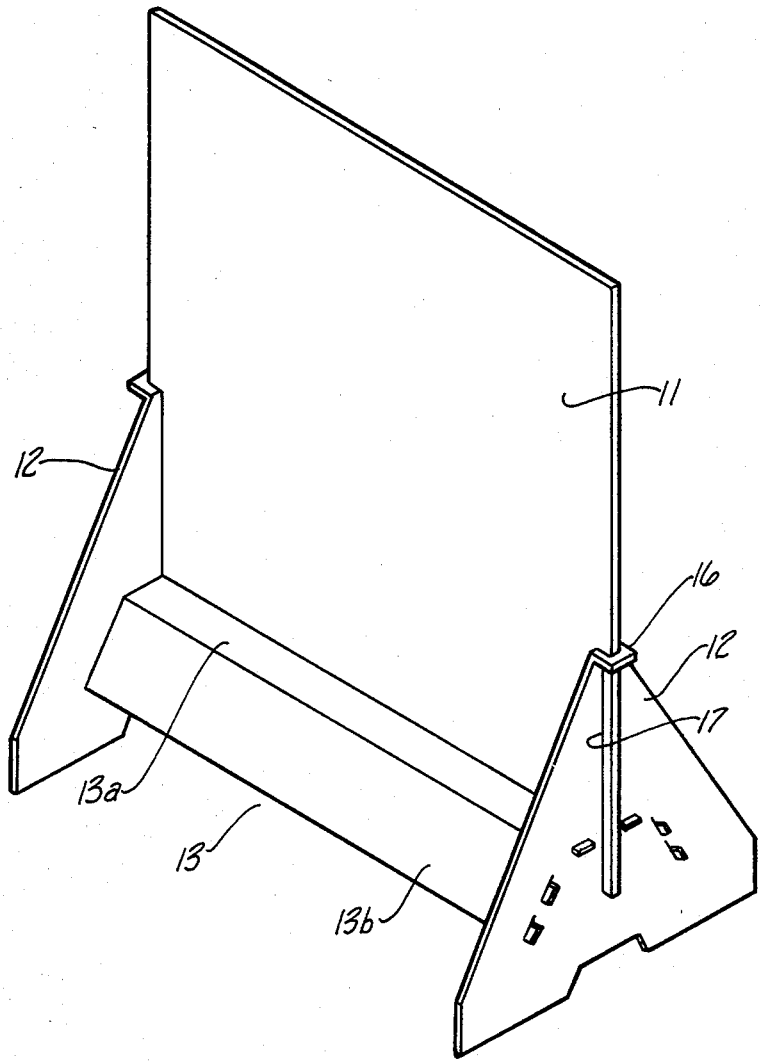
FIG. 1 is an isometric view of a display screen according to the first embodiment.
Figure 2:
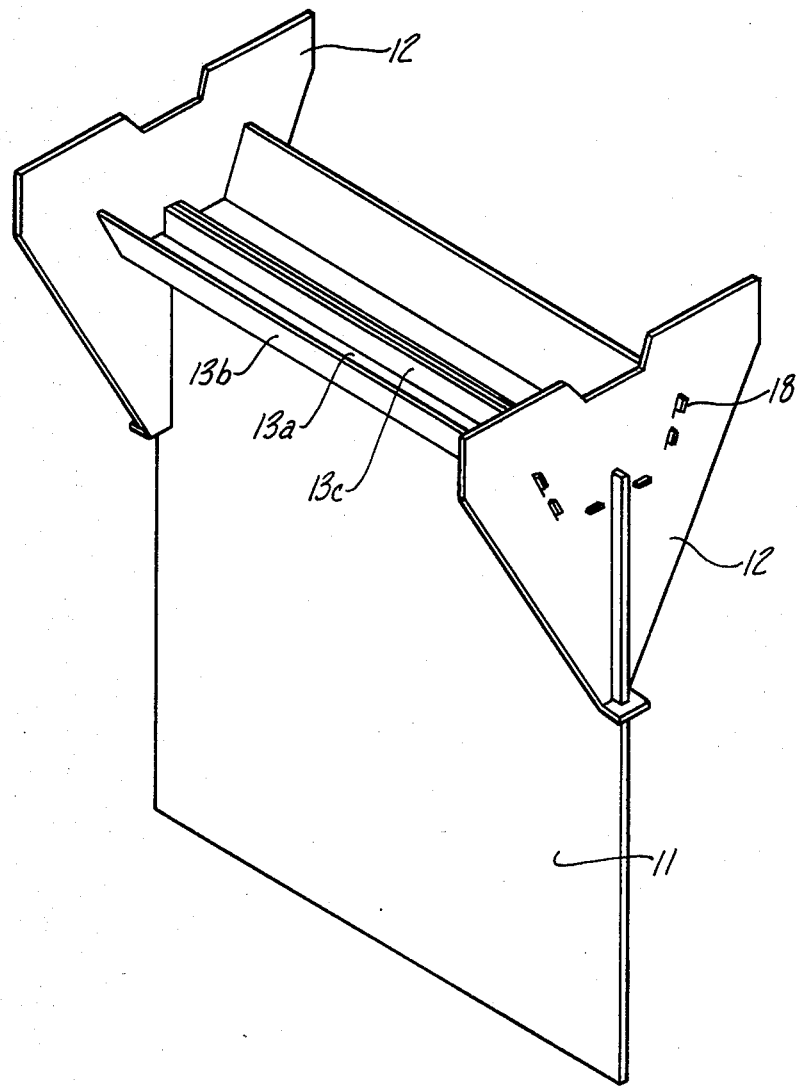
FIG. 2 is an underneath isometric view of the first embodiment.

The embodiments shown in the drawngs are directed towards portable, demountable display screens which may be readily assembled or demounted to facilitate their portability and which are formed of fibreboard whereby on said display screens becoming damaged or being of no further use they may be readily disposed by being pulped.

The first embodiment comprises a display screen having a display panel 11, a pair of end panels 12 and a brace member 13 each formed as a separate integer which are brought into inter-engagement to define a rigid light weight display screen. The display panel 11 is of a substantially rectangular configuration while the end panels 12 have the approximate configuration of an equilateral triangle of which the apex is formed with a transversly extending tab 16 and a slot 17 which extends for a considerable proportion of the width of the triangle from the apex along the line of bi-section of the triangle. The slot 17 extends partially along the length of the tab 16. By virtue of the slot 17 the display panel 11 can be located in each of the end panels to be supported thereby for a portion of the height of the display screen and by virtue of such engagement the display panel is prevented from pivotting about any point along the length of the slot. The function of the tab 16 serves in positively locating the end panels 12 at the sides of the display panel 11 and preventing the end panels from pivotting about the base of the slot 17 out of engagement with the display panel 11. The tabs further serve in preventing separation of the bifurcated portions of the end panels 12 where any transverse load is applied to the display panel 11.

The brace member 13 serves in preventing any twisting action between the end panels 12 about a vertical axis and relative movement between the end panels and the display panel 11 about a transverse horizontal axis. The brace member 13 comprises a substantially U-shaped member having a central web **13*a* which when the brace member is in position is intended to be substantially horizontal and extends between the end panels 12 to prevent relative pivotal movement between the end panels 12 and the display panel 11 about a vertical axis. The innermost edge of the central web 13*a* is intended to abut against the opposed face of the display panel 11 to prevent any relative outward movement of the base 11 which may result from a transverse load being applied to one of the faces of the display panel 11. The outermost flange 13*b* extends obliquely downwardly from the central web 13*a* and the end abuts with the end panels 12 to prevent any relative movement between the end panels 12 and the display panel 11 about a substantially horizontal axis. If desired the outer flange 13*b* may bear suitable art work or advertising indicia. The innermost flange 13*c* of the brace member 13 extends substantially vertically downwardly from the inner edge of the central member and its ends abut against the end panels 12 to reinforce the action of the outermost flanges 13*b* in preventng relative movement between the end panels 12 and the display panel 11 about a substantially horizontal axis. In addition the innermost flange 13*c* of both brace members 13 serve in clamping the lower edge of the display panel 11 therebetween to prevent relative outward movement of the lower edge of the display panel 11 in the horizontal plane as a result of any transverse loads applied to either face of the display panel 11**.

Figure 6:
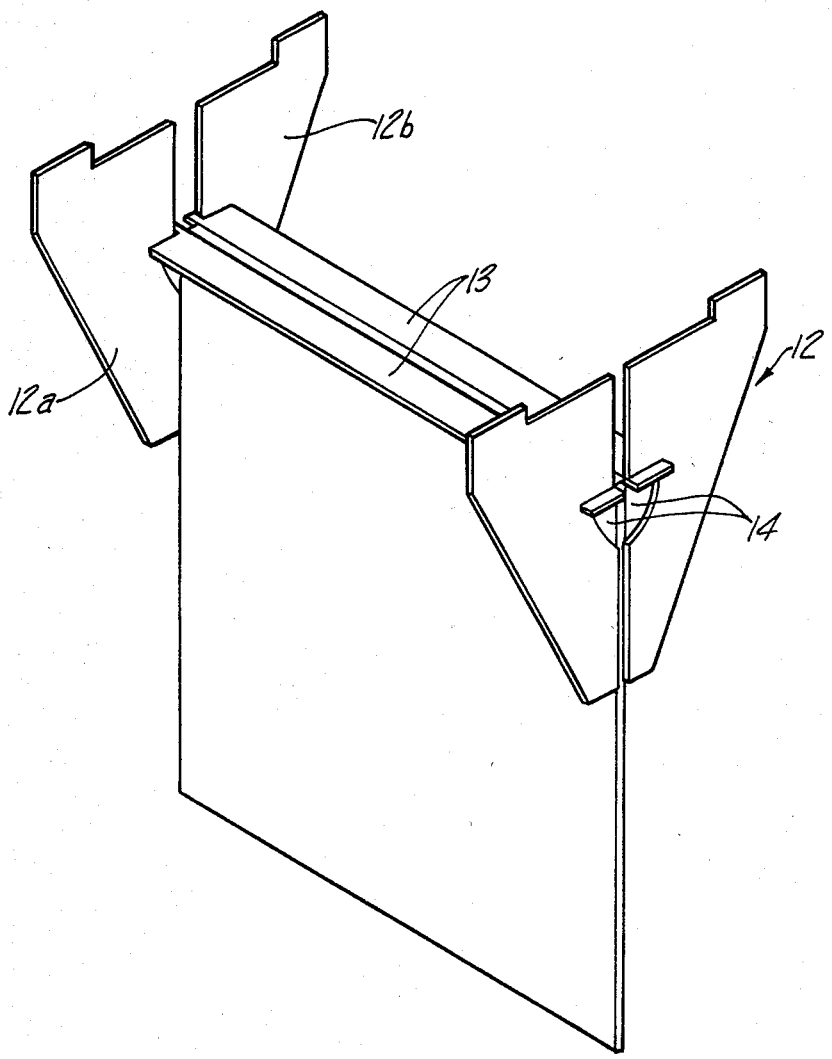
FIG. 6 is an underneath isometric view of the second embodiment.
Figure 7:
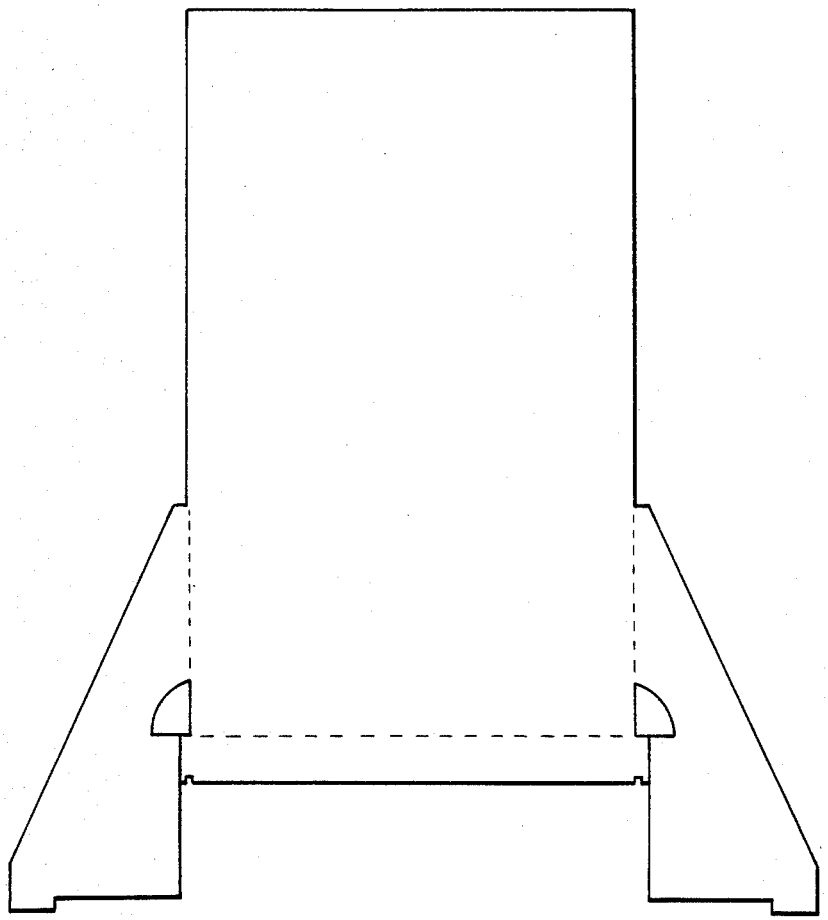
FIG. 7 is a plan view of the second embodiment in the unassembled form.

The display panel 11, end panels 12 and brace members 13 are formed of fibreboard and are initially formed as planar blanks. The blanks of the end panels 12 and brace members 13 are shown at FIGS. 7 and 6 respectively. The ends of the central web portion 13*a* and outer flange 13*b* of the brace member 13 are formed with outwardly extending tabs 18 which are to be received in correspondingly shaped slots 19 in the end panel 12 in order to positively locate the brace member in position between the end panels 12.

If desired the display panel 11 may be formed of a more substantial material. Similarly if desired the end panels 12 and/or the brace member 13 may be formed of a more substantial material and the inter-engagement between the brace members 13 and the end panels 12 may be effected by any suitable readily inter-engagable or disengagable means.

Figure 3:
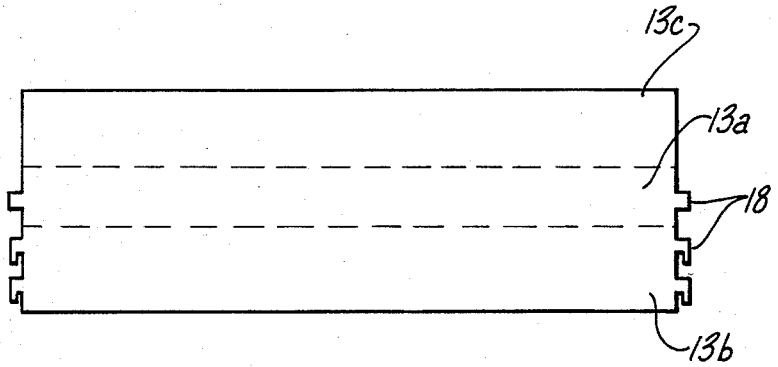
FIG. 3 is a plan view of the blank of the brace member of the first embodiment.
Figure 4:
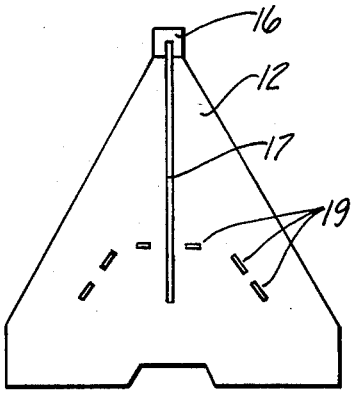
FIG. 4 is a plan view of the blank of the end panel of the first embodiment.
Figure 5:
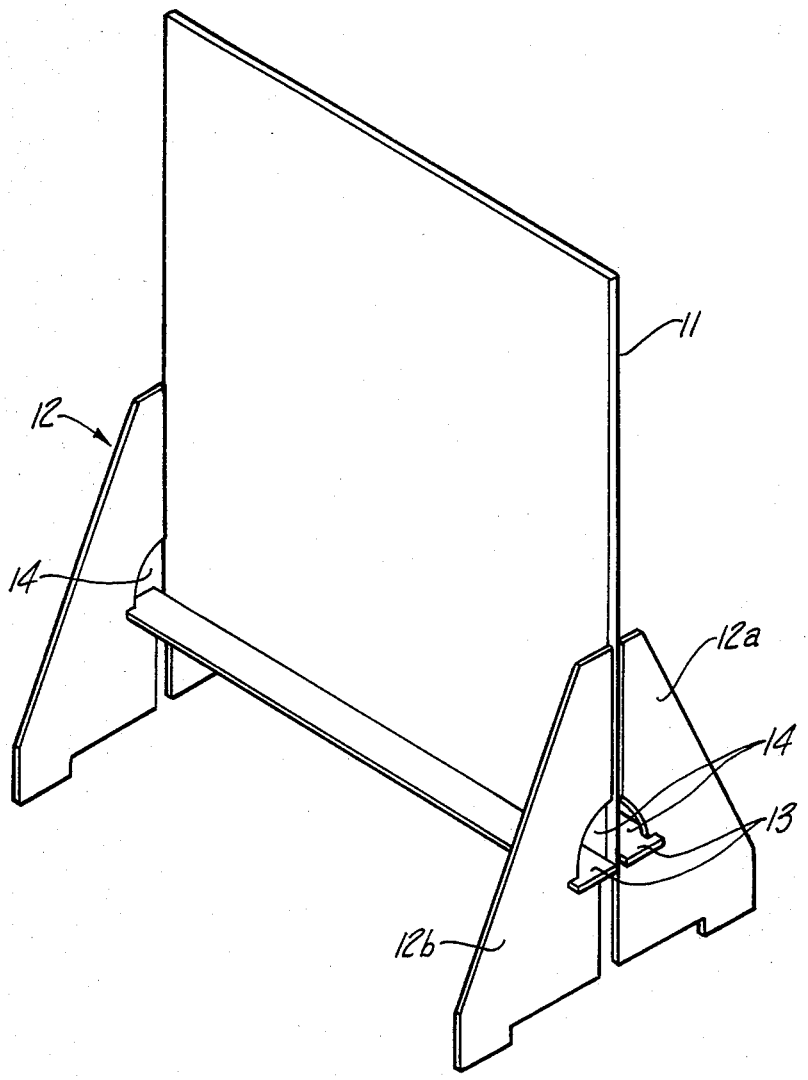
FIG. 5 is an isometric view of the display screen according to the second embodiment.

The second embodiment as shown in FIGS. 5, 6 and 7 is formed as a unitary body comprising a display screen 11, an end panel 12 and brace panel 13. The display panel 11 is of a substantially rectangular configuration and is formed of several thicknesses of fibreboard to provide it with a desired rigidity to enable posters, charts and the like to be suspended on the screen or alternatively to enable a person to write on the screen or on a substrate placed on the face of the panel. The end panel 12 comprises two triangular portions 12*a* and 12*b* having the configuration of a substantially right angled triangle hingedly mounted along one side to the same side of the display panel 11 in order that they may be movable from a position laying substantially co-planar with the display panel to a position where the portions extend in opposed relationship to each other and perpendicularly from the display panel 11. The lower edge of the display panel 11 hingedly supports a pair of brace panels 13 which extend beyond each side of the display 11 and are hingedly movable between a position where they lie substantially co-planar with the display panel to a position where the brace panels extend in opposed relationship to each other and perpendicularly from each side of the display panel 11. Each portion 12*a* and 12*b* of the end panels 12 are formed with a quadrant shaped opening 14 which is intended to receive the ends of the braces 13 which extend beyond the side of the display panel 11 when the portions 12*a* and 12*b* of the end panels 12 and the brace members 13 are located substantially perpendicular to the faces of the display panel 11. Notchs 15 are formed in the ends of the braces 13 to engage with the portions of the end panels 12 when braces 13 are located perpendicular to the display panel and the ends of the braces 13 are received within the quadrant shaped openings 14. As seen at FIG. 3 the quadrant shaped openings are in fact quadrants of an ellipse whereby the height of the openings is greater than the width of the opening to facilitate passage of the ends of the brackets 13 through the openings 14 as the end portions 12*a* and 12*b* are hinged and when the brace 13 defines an acute angle with the face of the display panel 11.

In use the display screen in its unassembled form may be readily packaged, stored and transported and when it is desired to use the display screen it may be readily assembled to form a rigid light weight screen.

If desired the display screen may be formed of a more substantial material then fibreboard such as hardboard, chipboard or ply and the pivotal connections of the end panels and brace may be effected by any suitable means such as hinges or the like.

It should be appreciated that the scope of the present invention need not be limited to the particular scope of the embodiment described above.

I claim:

1. A display screen comprising a planar display panel, a pair of end panels and a pair of brace members, each end panel being mounted at a respective side of the display panel extending transversly from said face thereof and having vertically extending surface engaging opposed portions of each face for a substantial portion of the height of the display panel, each brace member being located one to each side of the display panel and extending between said end panels and having a horizontal portion defining a surface extending between the end panels and in abutting relationship with the face of the display panel.

2. A display screen as claimed at claim 1 wherein said end panels each comprise two portions, each mounted to one or the other face of the display panel to be pivotal thereon for movement between a position extending transversly from the face of the display panel and a position substantially co-planar with said display panel.

3. A display screen as claimed at claim 2 wherein said brace members comprise an elongate member mounted to each face of the display panel to be pivotal between a position extending transversly from the face of said display panel and a position substantially coplanar therewith, the ends of said brace being lockingly inter-engagable with the portions of said end panel when both are substantially transverse to the face of the display panel.

4. A display screen as claimed at claim 1 wherein said end panels, brace members and display panel are formed as separate items readily engagable and disengagable from each other.

5. A display screen as claimed at claim 4 wherein said brace member includes a substantially vertical planar member extending between the end panels.

6. A display screen as claimed at claim 5 wherein the end panels are formed with a vertical slot into which the display panel is engaged.

7. A display screen as claimed at claim 6 wherein the vertical slot terminates towards the upper end of the end panel, said upper end being adapted to be pivoted to extend outwardly from the main face of the end panel about a transverse axis spaced along the slot from its termination.

8. A display screen as claimed at claim 7 wherein the display panel, brace members, and end panels are formed of fibreboard and are held in engagement with each other when in the mounted position by tabs on one member being received in suitably shaped apertures formed in the other member.

* * * * *